US008636416B2

(12) United States Patent
Sun et al.

(10) Patent No.: US 8,636,416 B2
(45) Date of Patent: Jan. 28, 2014

(54) LOWER SIDE BEARING FOR RAILROAD CAR WHEEL TRUCK

(71) Applicant: CSR Yangtze Co., Ltd., Wuhan (CN)

(72) Inventors: Mingdao Sun, Wuhan (CN); Yong Xu, Wuhan (CN); Baolei Wang, Wuhan (CN); Wanlu Gong, Wuhan (CN)

(73) Assignee: CSR Yangtze Co., Ltd., Wuhan (CN)

( * ) Notice: Subject to any disclaimer, the term of this patent is extended or adjusted under 35 U.S.C. 154(b) by 0 days.

(21) Appl. No.: 13/664,415

(22) Filed: Oct. 30, 2012

(65) Prior Publication Data

US 2013/0047883 A1 Feb. 28, 2013

Related U.S. Application Data

(63) Continuation-in-part of application No. PCT/CN2010/079597, filed on Dec. 9, 2010.

(30) Foreign Application Priority Data

May 14, 2010 (CN) ..... 2010 1 0176893

(51) Int. Cl.
*F16C 17/04* (2006.01)
*B61F 5/14* (2006.01)

(52) U.S. Cl.
USPC ..... 384/423; 105/199.3

(58) Field of Classification Search
USPC ..... 384/129, 158, 158.1, 215, 218, 422, 384/423; 105/199.3, 199.4, 218.1, 218.2, 105/219, 220
See application file for complete search history.

(56) References Cited

U.S. PATENT DOCUMENTS

| | | | | |
|---|---|---|---|---|
| 4,712,487 | A * | 12/1987 | Carlson | 105/199.3 |
| 5,749,301 | A * | 5/1998 | Wronkiewicz et al. | 105/199.3 |
| 2011/0011301 | A1 * | 1/2011 | O'Donnell et al. | 105/199.3 |

* cited by examiner

*Primary Examiner* — Thomas R Hannon
*Assistant Examiner* — Yamilka Pinero Medina
(74) *Attorney, Agent, or Firm* — Matthias Scholl P.C.; Matthias Scholl

(57) ABSTRACT

A lower side bearing for a wheel truck, including: a first friction board, a second friction board, an inner pedestal, a bearing sleeve sleeving the inner pedestal, a pressure block, a pressure plate, and an elastic component. The pressure block is disposed on an upper part of the inner pedestal, and the second friction board is disposed on a top of the pressure block. The pressure plate is disposed on an upper part of the bearing sleeve, and the first friction board is disposed on a top of the pressure plate. A friction coefficient $\mu_k$ of the first friction board and a friction coefficient $\mu_z$ of the second friction board meet the relation: $\mu_k > \mu_z$. The elastic component is disposed between the inner pedestal and the bearing sleeve for controlling a relative position of the inner pedestal and the bearing sleeve.

20 Claims, 3 Drawing Sheets

LOWER SIDE BEARING FOR RAILROAD CAR WHEEL TRUCK

CROSS-REFERENCE TO RELATED APPLICATIONS

This application is a continuation-in-part of International Patent Application No. PCT/CN2010/079597 with an international filing date of Dec. 9, 2010, designating the United States, now pending, and further claims priority benefits to Chinese Patent Application No. 201010176893.7 filed May 14, 2010. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The invention relates to a lower side bearing of a wheel truck for supporting load of a freight car body, and more particularly to a lower side bearing for supporting load in empty and heavy states.

2. Description of the Related Art

As a critical part of a railroad freight car, a typical wheel truck includes two side frame assemblies and a bolster assembly. Journal-box guides disposed on two ends of the frame assembly are fixed on a front wheel pair and a rear wheel pair via roller bearing adapters, respectively. The bolster assembly has two ends, each of which is mounted in a central square box of the side frame assembly via a spring suspension device for supporting the load from the bolster assembly. The bolster assembly includes a lower center plate in the center and two lower side bearings on two ends. The lower center plate and the lower side bearings are matched with an upper center plate and two upper side bearings on the lower base of the freight car for supporting the weight of the freight car.

In early supporting structure of the freight car, the lower center plate of the bolster assembly supported all loads of the car body, whereas the lower side bearings assisted for positioning. Thereafter, in order to improve the critical speed of an empty freight car, the lower center plate was improved as a primary bearing structure, and the lower side bearing was improved to assist for supporting. The friction between the upper and lower side bearings can act as a resistance during the turnaround of the wheel truck to meet the requirement of speed-raising.

In above descriptions, the supporting achieved totally by the lower center plate and the supporting achieved by the combination of the lower center plate and the lower side bearings are commonly called center plate-type supporting. The wheel truck having the center plate-type supporting is advantageous in that when crossing curved tracks, the wheel truck is flexible in turning around, and the load is uniformly distributed on the wheels. However, it has defects that the vertical load of the body is directly applied on the center of the bolster assembly, and transmitted to the square boxes via the bolster assembly, which results in a large bending moment and sectional area of the bolster assembly. Correspondingly, the weight and the production cost of the assembly are increased, and the center plate has a low stability in rolling.

To solve the above problems, two lower side bearings are employed to replace the center plate to support all loads from the car body. However, it is very difficult to design a bearing structure that meets the supporting requirements for both a heavy loaded state and an empty loaded state. During the heavy loaded state, the friction torque of the lower side bearing is too large, and the horizontal force on the curved wheel-track from the car body increases, thereby increasing the possibility of digression and the damage on the rim. To lower the friction torque in the heavy loaded state, decreasing the friction coefficient of the lower side bearings is practicable, which, however, will result in a too small friction torque in the empty loaded state, and thus, the critical speed of the wheel truck will be lowered during the empty loaded state. Therefore, developing a side bearing structure that can work well in both empty loaded state and heavy loaded state has actual significance for lowering the car body and improving the running performance of the freight car.

SUMMARY OF THE INVENTION

In view of the above-described problems, it is one objective of the invention to provide a lower side bearing comprising two friction boards for supporting loads in both empty and heavy loaded states. When the lower side bearing is used in a wheel truck, the weight of the bolster assembly can be reduced, and the stability of the bolster assembly can be improved. Thus, the performance and the running stability of the freight car when crossing curved tracks are improved, and requirement for speed-raising is achieved.

To achieve the above objective, in accordance with one embodiment of the invention, there is provided a lower side bearing, comprising: a first friction board, a second friction board, an inner pedestal, a bearing sleeve sleeving the inner pedestal, a pressure block, a pressure plate, and an elastic component. The pressure block is disposed on an upper part of the inner pedestal, and the second friction board is disposed on a top of the pressure block. The pressure plate is disposed on an upper part of the bearing sleeve, and the first friction board is disposed on a top of the pressure plate. A friction coefficient $\mu_k$ of the first friction board and a friction coefficient $\mu_z$ of the second friction board meet the relation: $\mu_k > \mu_z$. The elastic component is disposed between the inner pedestal and the bearing sleeve for controlling a relative position of the inner pedestal and the bearing sleeve. A mechanical property of the elastic component meets following requirements: a) in an empty loaded state, a level position of the first friction board is higher than that of the second friction board so that the first friction board bears the load of a car body; and b) in a heavy loaded state, the level position of the first friction board is equal to that of the second friction board so that the first friction board and the second friction board bear the load of the car body.

The lower side bearing comprises the first friction board and the second friction board for supporting load in empty and heavy states; and the relative position of such friction boards are limited by the elastic component. When the car body is in the empty state, the weight of the car body is supported only by the first friction board, at this moment, the lower side bearing is in an elastic state, acting as a third elastic suspension system. Because the first friction board has a larger friction coefficient and a large static deflection, the critical speed and the safety in wheel load reduction can be improved during the empty state. When the car body is in the heavy loaded state, the first friction board is pressed down to the same level position as the second friction board. In such a state, both the first friction board and the second friction board support the load of the car body, the lower side bearing is in a rigid supporting state, and the stability of the freight car during the rolling of the wheel is improved. Because the second friction board has a smaller friction coefficient, the wheel truck has a good performance in crossing the curved racks in the heavy loaded state.

In a class of this embodiment, the pressure block is in connection with the upper part of the inner pedestal to form a spherical structure comprising a convex surface and a corresponding concave surface. Specifically, the pressure block comprises an upper short column and a lower hemispheroid. The upper short column comprises a top on which the second friction board disposed, and an outer wall encircled by a retaining ring. The lower hemispheroid is flexibly received by the concave surface of the spherical structure on the upper part of the inner pedestal. On one hand, the second friction board can be firmly fixed on the pressure block; on the other hand, the spherical structure comprising the concave surface and the convex surface allows the pressure block to be well matched with the inner pedestal. Even when deviations exist in some components, the spherical structure can assure good attachment between the second friction board and the upper side bearing of the car body during the heavy loaded state, and further assures the operation stability and reliability of the upper and lower side bearings.

Advantages of the invention are summarized as follows.

First of all, the lower side bearing comprises two friction boards for supporting load in both empty and heavy states. In the empty state, the first friction board having a larger friction coefficient can produce a large friction torque to improve the critical speed; whereas in the heavy state, the second friction board having a smaller friction coefficient can prevent the friction torque of the side bearing from being too large, and further reduce the horizontal force on the curved wheel track exerted by the car body. Thus, the heavy loaded wheel truck has a superb dynamic performance for crossing curved tracks. Furthermore, when the lower side bearing of the invention is used in a wheel truck, the weight of the bolster assembly can be reduced, and the stability of the bolster assembly can be improved. Thus, the wheel truck has a good performance in crossing curved tracks, stable running, and meets the requirement of the speed-raising.

BRIEF DESCRIPTION OF THE DRAWINGS

The invention is described hereinbelow with reference to the accompanying drawings, in which.

DETAILED DESCRIPTION OF THE EMBODIMENTS

To further illustrate the invention, experiments detailing a lower side bearing are described. It should be noted that the following examples are intended to describe and not limited to the invention.

Figure 1:
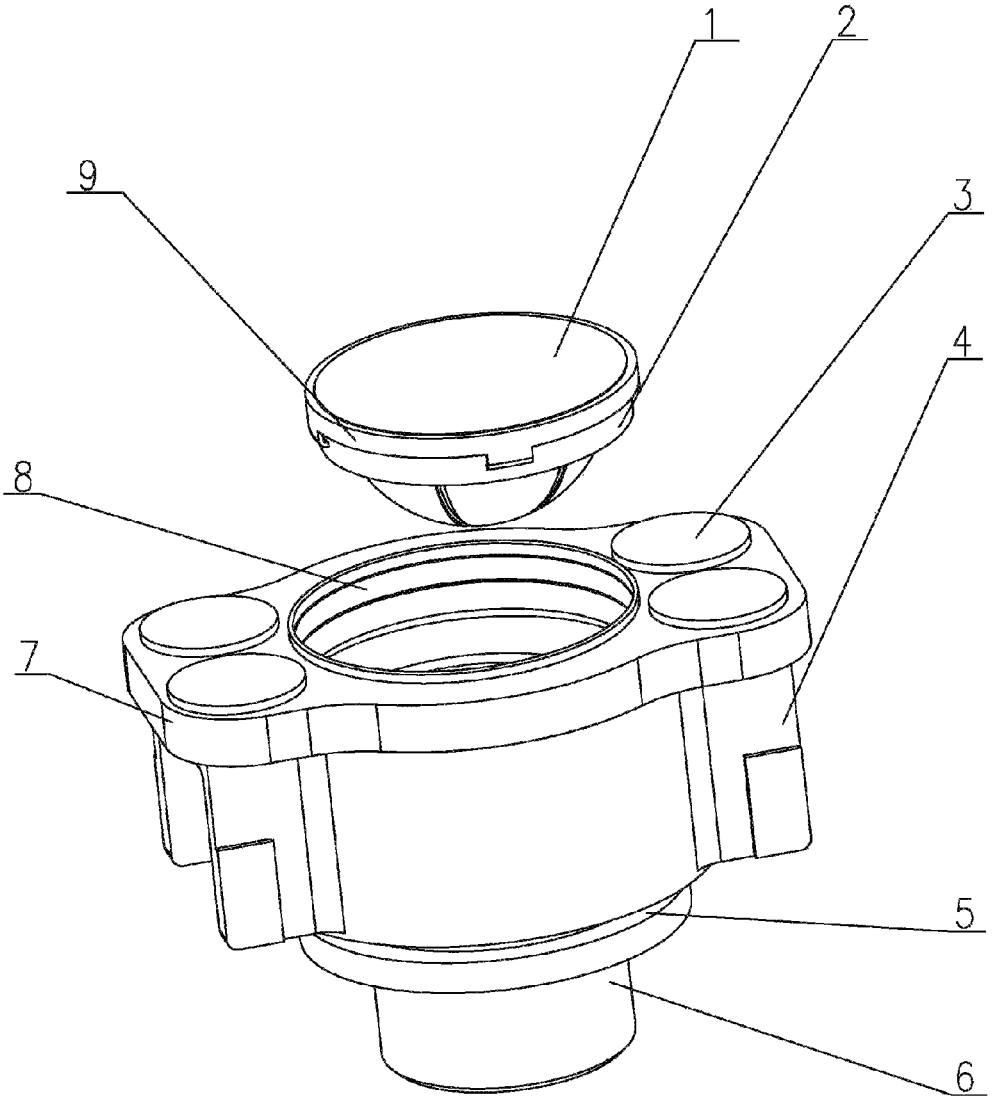
FIG. 1 is a structure diagram of a lower side bearing comprising two friction boards for supporting loads in both empty and heavy loaded states.
Figure 2:
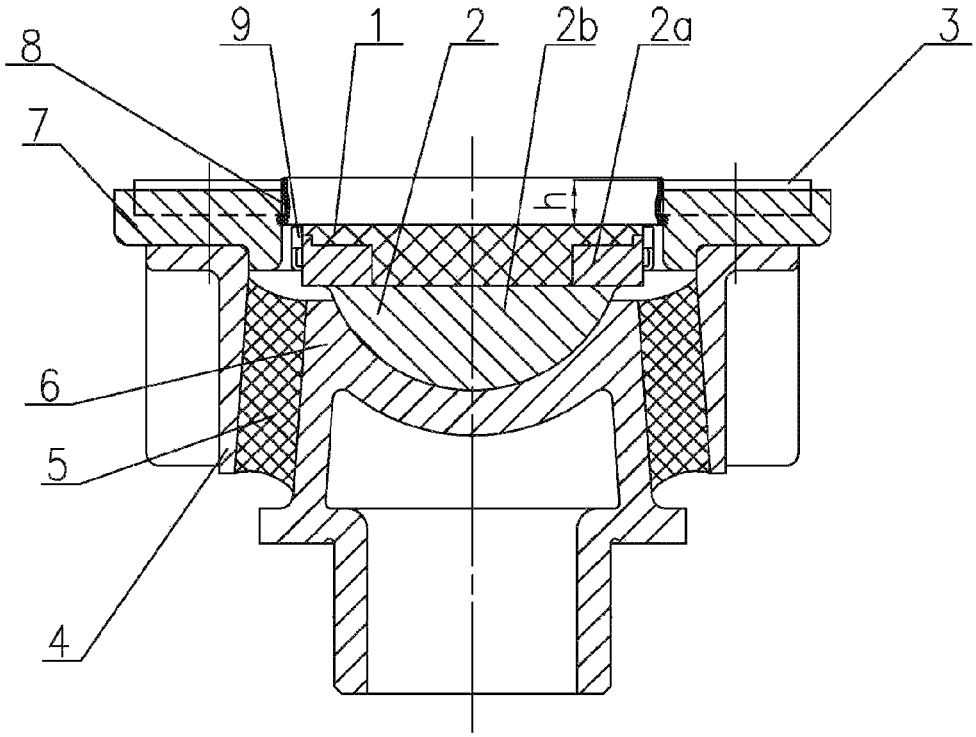
FIG. 2 is a cross-sectional view of a lower side bearing comprising an elastic component made of a conical rubber layer FIG. 1.
Figure 3:
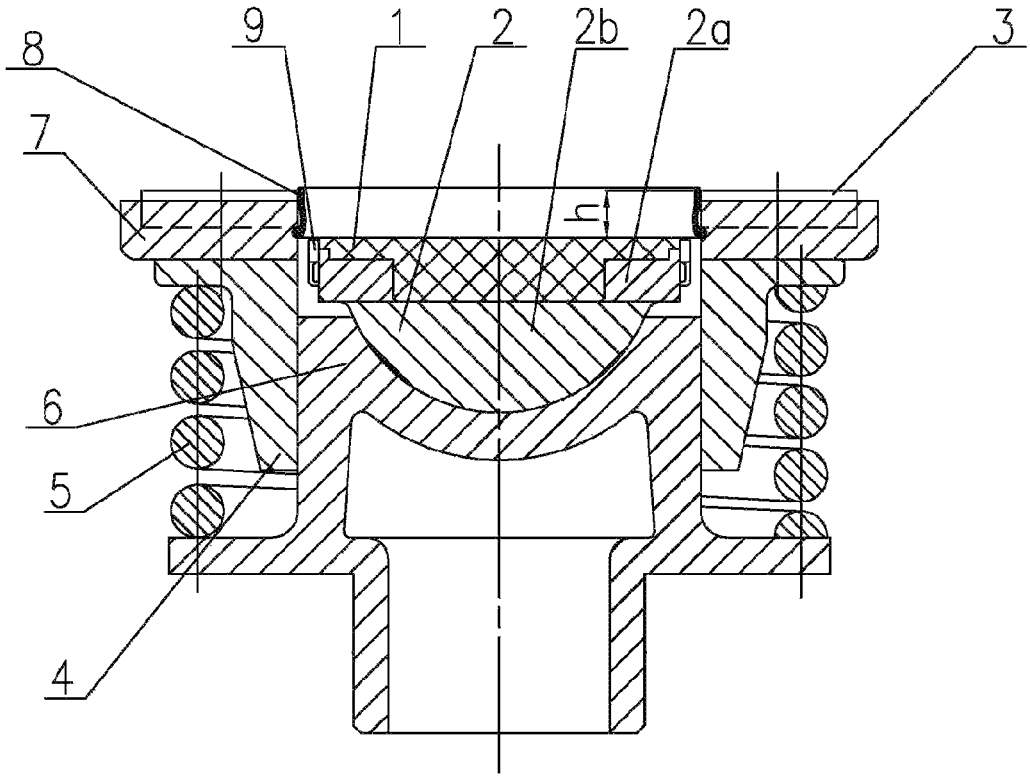
FIG. 3 is a cross-sectional view of a lower side bearing comprising an elastic component made of a spiral reset spring of FIG. 1.

As shown in FIGS. 1-3, a lower side bearing comprising two friction boards for supporting loads in both empty and heavy loaded states comprises: an inner pedestal 6 in a center and a bearing sleeve 4 that sleeves the inner pedestal 6 and can move upwards and downwards relative to the inner pedestal 6. A pressure block 2 is disposed on an upper part of the inner pedestal 6, and a second friction board 1 is disposed on a top of the pressure block 2. A pressure plate 7 is disposed on an upper part of the bearing sleeve 4, and a first friction board 3 is disposed on a top of the pressure plate 7. A friction coefficient $\mu_k$ of the first friction board 3 and a friction coefficient $\mu_z$ of the second friction board 1 meet the relation: $\mu_k > \mu_z$. An elastic component 5 is disposed between the inner pedestal 6 and the bearing sleeve 4 for controlling a relative position of the inner pedestal 6 and the bearing sleeve 4. A mechanical property of the elastic component 5 meets following requirements: a) in an empty loaded state, a level position of the first friction board 3 is higher than that of the second friction board 1 so that the first friction board bears the load of a car body (a height difference h is labeled in FIGS. 2-3); and b) in a heavy loaded state, the level position of the first friction board 3 is equal to that of the second friction board 1 so that the first friction board and the second friction board bear the load of the car body. In general, the second friction board 1 can be made of polymer materials which not only have good abrasion resistant capacity, but also meet the requirement for heavy load. The first friction board 3 can be made of modified nylon materials which not only have a large friction coefficient, but also have good capacity of anti-abrasion and anti-corrosion, and thus, it can alleviate the abrasion on the upper side bearings, is convenient to maintain and displace, and largely lowers the production cost.

The height difference h controlled by the elastic component 5, the friction coefficient $\mu_k$ of the first friction board 3 and the friction coefficient $\mu_z$ of the second friction board 1 can be designed or adjusted according to the empty load state and the heavy load state, respectively. In actual manufacturing, the lower side bearing employs the following two structures: One is that an outer wall of the inner pedestal 6 and an inner wall of the bearing sleeve 4 are in the form of conical structures. The elastic component 5 is a conical rubber layer disposed between the outer wall of the inner pedestal 6 and the inner wall of the bearing sleeve 4; and the elastic component 5, the outer wall of the inner pedestal 6, and the inner wall of the bearing sleeve 4 are integrated as a whole by sulfurization (as shown in FIG. 2). Because the shear elasticity of the conical rubber layer is larger than its pressure elasticity, the elastomer formed by the inner pedestal 6, the bearing sleeve 4, and the elastic component 5 has a smaller vertical rigidity and a larger radial rigidity, so that the elastomer can specifically locate the second friction board 1 and the first friction board 3. The other is that the outer wall of the inner pedestal 6 and the inner wall of the bearing sleeve 4 are in the form of sliding fitted cylindrical structures. The elastic component 5 is a spiral reset spring disposed between a lug boss of the outer wall of the inner pedestal 6 and a flange of the inner wall of the bearing sleeve 4 (as shown in FIG. 3). The spiral reset spring has a simple structure; it is not only convenient for manufacturing, installation, and displacement, but also apt to specifically locate the second friction board 1 and the first friction board 3.

Preferably, the pressure block 2 is in connection with the upper part of the inner pedestal 6 to form a spherical structure comprising a convex surface and a corresponding concave surface. Specifically, the pressure block 2 comprises an upper short column 2*a*, and a lower hemispheroid 2*b*. The upper short column 2*a* comprises a top on which the second friction board 1 disposed, and an outer wall encircled by a retaining ring 9. The lower hemispheroid 2*b* is flexibly received by the concave surface of the spherical structure on the upper part of the inner pedestal 6. This structure maintains a good attachment between the second friction board 1 and the upper side bearing of the car body. The force from the car body is evenly distributed on the friction surface, and thus, a stable friction is produced, and the safety for crossing curved track is further improved during heavy loaded state.

To prevent dusts and other grains from falling into the spherical structure between the pressure block 2 and the inner pedestal 6, a scraper seal 8 is disposed between an inner circle of the pressure plate 7 and an outer circle of the pressure block 2. Specifically, the scraper seal 8 is disposed on the inner circle of the pressure plate 7.

To maintain the uniformity of the force distribution, the number of the first friction board 3 is even, and the first friction boards 3 are symmetrically disposed on two sides of the top of the pressure plate 7. Specifically, the first friction boards 3 are 4 in number, and are symmetrically disposed on two sides of the top of the pressure plate 7.

Working principle of the lower side bearing is as follows: when the car body is in an empty loaded state, the first friction board 3 is higher than the second friction board 1, that is, a height difference h is formed. In such a state, the upper side bearing presses on the first friction board 3 only. Because the deflection which is produced by the elastomer of the lower side bearing due to the weight of the car body is smaller than the height difference h, the lower side bearing is in an elastic state, and acts as a third elastic suspension system when the freight car is empty loaded. Further, because the first friction board 3 has a larger friction coefficient $\mu_k$, it assures a high critical speed of the wheel truck in the empty loaded state. When the car body is in a heavy loaded state, the first friction board 3 is pressed down and in the same level with the second friction board 1, that is, the height difference between the first friction board 3 and the second friction board 1 is equal to zero. In such a state, the upper side bearing presses on both the first friction board 3 and the second friction board 1. Because the deflection which is produced by the elastomer of the lower side bearing due to the weight of the car body and the load is equal to or even larger than the height difference h, the lower side bearing is in a rigid supporting state and most of the load from the car body is supported by the second friction board 1 when the freight car is heavy loaded. Furthermore, because the second friction board 1 has a smaller friction coefficient $\mu_z$, the wheel truck has a good performance in crossing the curved racks during the heavy loaded state.

The lower side bearing of the invention is applicable not only in wheel trucks which are supported totally by the side bearings, but also in wheel trucks employing the center plate as a primary supporting structure and the side bearings as a secondary supporting structure.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A bearing, comprising:

a) a first friction board (3);

b) a second friction board (1);

c) an inner pedestal (6);

d) a bearing sleeve (4) sleeving the inner pedestal (6);

e) a pressure block (2);

f) a pressure plate (7); and g) an elastic component (5);

wherein the pressure block (2) is disposed on a part of the inner pedestal (6), and the second friction board (1) is disposed on a top of the pressure block (2);

the pressure plate (7) is disposed on a part of the bearing sleeve (4), and the first friction board (3) is disposed on a top of the pressure plate (7);

a friction coefficient $\mu_k$ of the first friction board (3) and a friction coefficient $\mu_z$ of the second friction board (1) meet the relation: $\mu_k > \mu_z$;

the elastic component (5) is disposed between the inner pedestal (6) and the bearing sleeve (4) for controlling a relative position of the inner pedestal (6) and the bearing sleeve (4); and a mechanical property of the elastic component (5) meets following requirements: a) in an empty loaded state, a level position of the first friction board (3) is higher than that of the second friction board (1) so that the first friction board bears the load of a car body; and b) in a heavy loaded state, the level position of the first friction board (3) is equal to that of the second friction board (1) so that the first friction board and the second friction board bear the load of the car body.

2. The bearing of claim 1, wherein an outer wall of the inner pedestal (6) and an inner wall of the bearing sleeve (4) are in the form of conical structures;

the elastic component (5) is a conical rubber layer disposed between the outer wall of the inner pedestal (6) and the inner wall of the bearing sleeve (4); and the elastic component (5), the outer wall of the inner pedestal (6), and the inner wall of the bearing sleeve (4) are integrated as a whole by sulfurization.

3. The bearing of claim 2, wherein the pressure block (2) is in connection with the part of the inner pedestal (6) to form a spherical structure comprising a convex surface and a corresponding concave surface.

4. The bearing of claim 3, wherein the pressure block (2) comprises a short column (2*a*) and a hemispheroid (2*b*) ;

the short column (2*a*) comprises a top on which the second friction board (1) is disposed, and an outer wall encircled by a retaining ring (9); and the hemispheroid (2*b*) is flexibly received by the concave surface of the spherical structure on the part of the inner pedestal (6).

5. The bearing of claim 2, wherein a scraper seal (8) is disposed between an inner circle of the pressure plate (7) and an outer circle of the pressure block (2).

6. The bearing of claim 5, wherein the scraper seal (8) is disposed on the inner circle of the pressure plate (7).

7. The bearing of claim 2, wherein the second friction board (1) is made of polymer materials, and the first friction board (3) is made of modified nylon materials.

8. The bearing of claim 1, wherein an outer wall of the inner pedestal (6) and an inner wall of the bearing sleeve (4) are in the form of sliding fitted cylindrical structures; and the elastic component (5) is a spiral reset spring disposed between a lug boss of the outer wall of the inner pedestal (6) and a flange of the inner wall of the bearing sleeve (4).

9. The bearing of claim 8, wherein the pressure block (2) is in connection with the part of the inner pedestal (6) to form a spherical structure comprising a convex surface and a corresponding concave surface.

10. The bearing of claim 9, wherein the pressure block (2) comprises a short column (2*a*) and a hemispheroid (2*b*);

the short column (2*a*) comprises a top on which the second friction board (1) is disposed, and an outer wall encircled by a retaining ring (9); and the hemispheroid (2*b*) is flexibly received by the concave surface of the spherical structure on the part of the inner pedestal (6).

11. The bearing of claim 8, wherein a scraper seal (8) is disposed between an inner circle of the pressure plate (7) and an outer circle of the pressure block (2).

12. The bearing of claim 11, wherein the scraper seal (8) is disposed on the inner circle of the pressure plate (7).

13. The bearing of claim 8, wherein the second friction board (1) is made of polymer materials, and the first friction board (3) is made of modified nylon materials.

14. The bearing of claim 1, wherein the pressure block (2) is in connection with the part of the inner pedestal (6) to form a spherical structure comprising a convex surface and a corresponding concave surface.

15. The bearing of claim 14, wherein the pressure block (2) comprises a short column (2*a*) and a hemispheroid (2*b*);

the short column (2*a*) comprises a top on which the second friction board (1) is disposed, and an outer wall encircled by a retaining ring (9); and the hemispheroid (2*b*) is flexibly received by the concave surface of the spherical structure on the part of the inner pedestal (6).

16. The bearing of claim 1, wherein a scraper seal (8) is disposed between an inner circle of the pressure plate (7) and an outer circle of the pressure block (2).

17. The bearing of claim 16, wherein the scraper seal (8) is disposed on the inner circle of the pressure plate (7).

18. The bearing of claim 1, further comprising additional first friction boards (3), wherein the number of the first friction boards (3) is even, and the first friction boards (3) are symmetrically disposed on two sides of the top of the pressure plate (7).

19. The bearing of claim 18, wherein the number of the first friction boards (3) is four.

20. The bearing of claim 1, wherein the second friction board (1) is made of polymer materials, and the first friction board (3) is made of modified nylon materials.

* * * * *